US005309834A

United States Patent [19]

Koch

[11] Patent Number: 5,309,834

[45] Date of Patent: May 10, 1994

[54] ROTARY PRINTING MACHINE

[75] Inventor: Dieter Koch, Oberrohrdorf, Switzerland

[73] Assignee: Asea Brown Boveri Ltd., Baden, Switzerland

[21] Appl. No.: 34,807

[22] Filed: Mar. 19, 1993

[30] Foreign Application Priority Data

Apr. 30, 1992 [DE] Fed. Rep. of Germany ..... 4214394

[51] Int. Cl.[5] ..... B41F 13/24

[52] U.S. Cl. ..... 101/248; 364/469; 364/478

[58] Field of Search ..... 101/247, 248, 211, 212, 101/216, 217, 218, 219, 181, 226; 493/35; 364/478, 469

[56] References Cited

U.S. PATENT DOCUMENTS

| | | | |
|---|---|---|---|
| 4,177,730 | 12/1979 | Schriber et al. | 101/219 |
| 4,240,346 | 12/1980 | Landis et al. | 101/181 |
| 4,495,582 | 1/1985 | Dessert et al. | 364/469 |
| 4,514,819 | 4/1985 | Punater et al. | 493/35 |
| 4,690,051 | 9/1987 | Kishine et al. | 101/211 |
| 4,723,488 | 2/1988 | Inouye et al. | 101/218 |
| 4,803,634 | 2/1989 | Ohno et al. | 364/478 |
| 4,839,814 | 6/1989 | Steidel | 364/469 |

FOREIGN PATENT DOCUMENTS

| | | |
|---|---|---|
| 3515626 | 10/1985 | Fed. Rep. of Germany . |
| 3602894 | 8/1987 | Fed. Rep. of Germany . |
| 3642500 | 6/1988 | Fed. Rep. of Germany . |
| 3839248 | 5/1990 | Fed. Rep. of Germany . |

OTHER PUBLICATIONS

Der Polygraph 17/86, pp. 1645–1650. "Innovative Steuerungssysteme fur vollautomatisierte Druckmaschinen".

Zeitungstechnik, Dec. 1991, pp. 78–80. "Rotationsmaschinenantrieb ohne Langswelle—eine Wiederentdeckung von Hamada".

H-D. Schafer, Siemens Energie & Automation 8, 1986, pp. 116–118.

Der Polygraph 18/91, p. 1448. "Zentralantrieb oder Einzelmotoren?".

H. Walkner, Brown Boveri Mitt, 1972, pp. 109–110. "Digitale Sollwertvorgabe, Schlingenregelung und Folgesteuerung bei kontinuierlichen Walzstrassen".

Deutscher Drucker, Nr. 30, Sep. 24, 1987, pp. 140–142, 145–150, 152, 154–157. "Neue Leitstandtechnik im Zeitungsdruck".

*Primary Examiner*—Eugene H. Eickholt

*Attorney, Agent, or Firm*—Oblon, Spivak, McClelland, Maier & Neustadt

[57] ABSTRACT

In a rotary printing machine with directly driven cylinders and at least one directly driven folding unit (12), those drives of the cylinders and their drive controllers which can be assigned to a paper web are combined to form printing-station groups (2). The printing-station groups (2*a–d*) are connected to one another, to the folding unit (12) and to the operating and data-processing unit (1) via a data bus (3). Within the printing-station group (2), the individual drives of the cylinders and their drive controllers are connected via a high-speed bus system. The printing-station groups (2*a–d*) acquire their position reference directly from the folding unit (12). The master control system (1) is now responsible only for the presetting of desired values and desired-value deviations and the processing of actual values. The division of the overall control system into a master control system and autonomous printing-station groups (2) achieves that simplicity, flexibility and robustness in respect of faults which is necessary for producing a directly driven rotary printing machine.

11 Claims, 2 Drawing Sheets

ROTARY PRINTING MACHINE

BACKGROUND OF THE INVENTION

Field of the Invention

The invention relates to the field of printing technology. It relates, in particular, to a rotary printing machine having individually driven cylinders.

Such an individually driven rotary printing machine is described on pages 78 to 80 of the periodical "Zeitungstechnik" ["Newspaper Technology"] of December 1991.

Discussion of Background

In an individually driven rotary printing machine, the mechanical shaft connections (longitudinal and vertical shafts) and most gears are omitted. Each cylinder is driven directly by a separate motor.

The abovementioned article sets forth the technical development in the field of directly driven rotary printing machines. The idea of a rotary printing machine which is free of longitudinal shafts was tried out as early as the mid-60's by the Swiss printing-machine factory Wifag. However, the attempt failed because stable running was not achieved in the lower speed range. It was therefore impossible to satisfy the high requirements as regards accuracy. A fresh attempt was made in 1978 by Messrs. MAN Roland Druckmaschinen AG. The test machine successfully underwent all the tests. It was also possible to meet the requirements as to accuracy. The accuracy of conventional rotary printing machines driven by longitudinal shafts was even exceeded. The advantages of a directly driven rotary printing machine are many and various and comprise:

- increased register accuracy,
- more exact printing results as a result of the omission of gear plays,
- no further need for a circumferential register, since the positions of the drives can be displaced relative to one another,
- simplified mechanical construction of the rotary printing machine,
- easier possibility of extension of the machine.

Nevertheless, it was impossible for the principle of the individual drive to gain acceptance. The reasons for this are the complexity of the regulation of the individual drives, the interlinking of the control system and the resulting susceptibility to faults and restricted flexibility of construction.

SUMMARY OF THE INVENTION

Accordingly, one object of the present invention is to provide a novel directly driven rotary printing machine which has the abovementioned advantages and which avoids the disadvantages of complexity, susceptibility to faults and lack of flexibility of the control system by means of its special construction.

In a rotary printing machine, comprising a) a number of individually driven cylinders, the drives taking place by means of electric motors, and b) at least one separately driven folding unit, this object is achieved in that c) the individual drives of the cylinders and their drive controllers are combined in any way to form printing-station groups, d) the printing-station groups are assigned to one of the folding units and acquire their position reference from this folding unit, and e) the management of the printing-station groups takes place by means of a master control system.

The combination of the individual drives and their drive controllers to form any printing-station groups and the fact that the printing-station groups require their position reference from the folding unit result in an overall control system which is distinguished by simplicity and flexibility.

In a first preferred embodiment, the rotary printing machine is used in an arrangement which is defined in that a) the individual drives and their drive controllers of a printing-station group are connected via a high-speed bus system, the drive bus, b) the printing-station groups are connected to one another and to an operating and data-processing unit via a data bus, and c) the data-processing unit manages the printing-station groups, d) this management comprising the presetting of desired values and desired-value deviations and the processing of actual values and coordinating the desired-value command of the various printing-station groups relative to one another and relative to the folding unit, e) the at least one folding unit is connected to the printing-station groups via the data bus.

The advantage of the construction according to the invention is that the overall control system of rotary printing machine becomes very simple and unsusceptible to faults as a result of the combination of the individual drives to form any printing-station groups via a high-speed bus system. The individual printing-station groups are independent of one another and acquire their position reference from the folding unit assigned to them. The management of the printing-station groups takes place, via a master control system and now comprises only the presetting of desired values and desired-value deviations and the processing of actual values.

The overall control system of a directly driven rotary printing machine is so complicated particularly because the cylinders have to be positioned to an accuracy of 0.05 mm at a cylinder circumferential speed of 13 m/s. Very high demands are made to the same degree of the data-transmission speed and the connecting bus system. Only the division according to the invention of the overall control system into drive groups, the components of which are connected via a high-speed bus system, for time-critical regulation and a master control system, which may easily have a lower data-transmission speed, for the time-uncritical tasks, such as the presetting of desired values and desired-value deviations and the processing of actual values, makes it possible, despite the high accuracy requirements, to obtain a simple and robust construction.

Since the individual printing-station groups acquire their reference from the associated folding unit and the position of the entire group can be displaced in relation to the folding unit, there is no longer any need for a main register. A further advantage of the arrangement according to the invention is that the machine can have a flexible configuration, since mechanical connections do not have to be borne in mind. The overall control system is therefore not fully interlinked, but has clear interfaces. It is thereby also insensitive to faults, for example of an individual drive, since these relate only to an individual printing-station group.

The essence of the invention is, therefore, to provide a directly driven rotary printing machine which is distinguished by simplicity and robustness of the control system. This is achieved in that the overall control system is divided into autonomous printing-station groups and a master control system. The individual drives of the cylinders and their drive controllers within a printing-station group are connected via a high-speed bus system matched to the time-critical tasks. The printing-station groups are connected to one another and to the master control system via a master bus system. This bus system can have a lower data-transmission speed, since it has to deal with only time-uncritical tasks. The printing-station groups acquire their position reference directly from the associated folding unit. The relative position of the cylinders to a printing-station group in relation to one another is set independently of the master control system via the high-speed bus system. During operation, therefore, the individual printing-station groups have a high degree of autonomy.

As a result of said division of the overall control system into a master control system and autonomous printing-station groups, the overall control system has that degree of simplicity, flexibility and robustness in respect of faults which is necessary for producing a directly driven rotary printing machine.

Further advantageous embodiments emerge from the dependent claims, taken as a whole.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

In a rotary printing machine which is individually driven or free of longitudinal shafts, each cylinder, especially the impression and back-up cylinders, and the folding unit are driven by their own electric motor. This does away with the mechanical connections. The individual drives must, of course, be coordinated with one another. In view of the high requirements as to positioning accuracy, the connecting bus system must have a high data-transmission speed. The nearest starting-point for regulating all the drives by means of a single central master unit fails because of complexity and restricted flexibility. Now the rotary printing machine according to the invention proceeds from a completely different starting-point. This is to be explained in association with the Figures.

Figure 1:
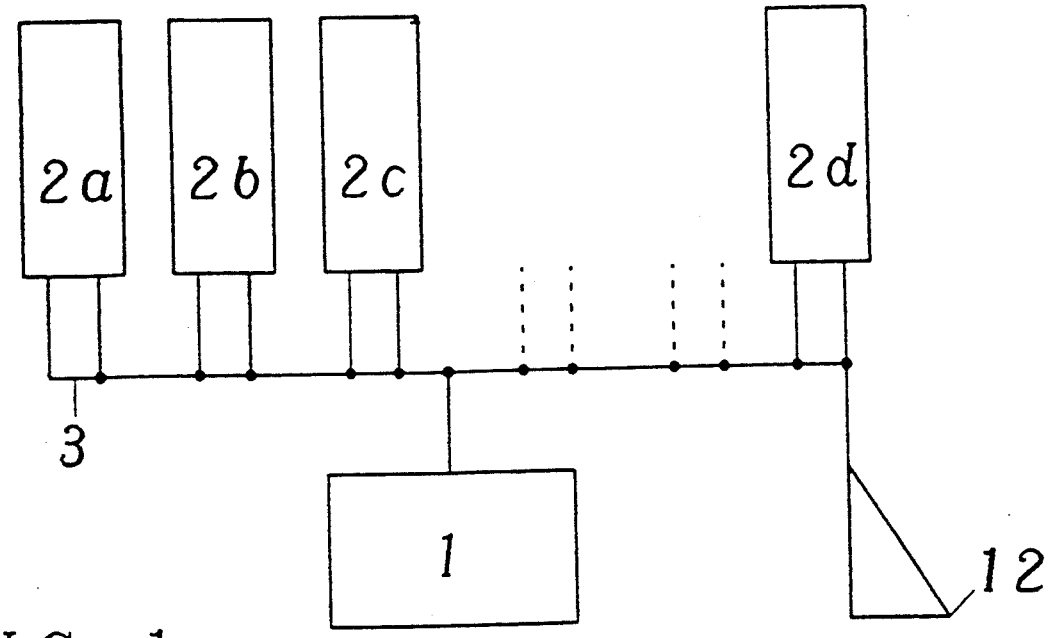
FIG. 1 shows a block diagram of a directly driven rotary printing machine according to the invention.

Referring now to the drawings, wherein line reference numerals designate identical or corresponding parts throughout the several views, FIG. 1 shows a block diagram of a rotary printing machine according to the invention. It has k printing-station groups (*2a–d*) which are connected via a data bus (3) both to the operating and data-processing unit (1) and to the folding unit (12). The individual drives of the cylinders and their drive controllers are combined to form printing-station groups (*2a–d*). These printing-station groups (*2a–d*) are now connected only to the operating and data-processing unit, that is to say to the master control system (1). The printing-station groups acquire their position reference directly from the folding unit (12). They therefore have a high degree of autonomy.

Figure 2:
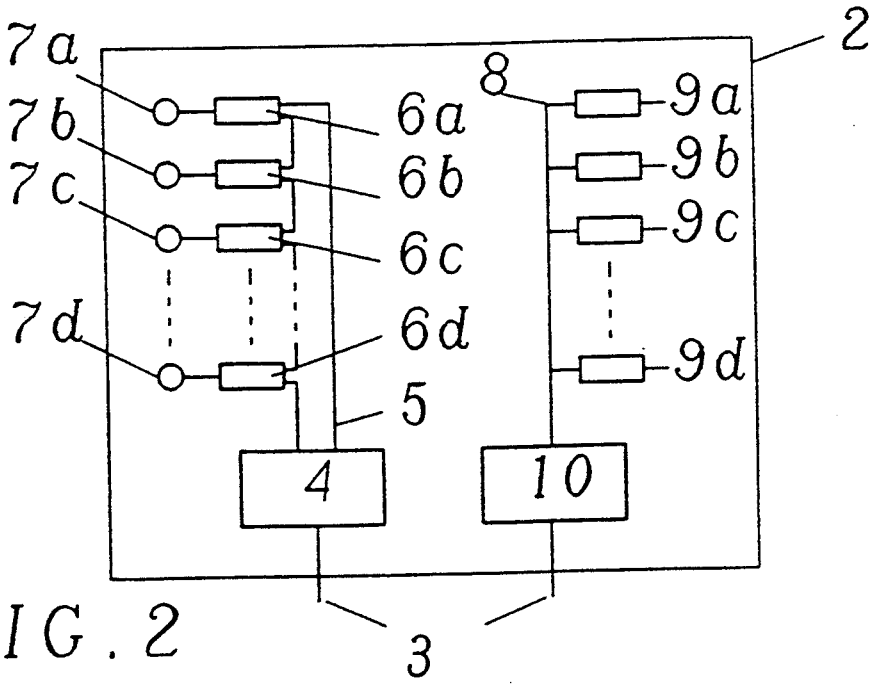
FIG. 2 shows a block diagram of a printing-station group according to the invention.

FIG. 2 shows a block diagram of an individual printing-station group (2). There are n individual drives (*7a–d*) and n associated drive controllers (*6a–d*). The drive controllers (*6a–d*) are connected to a drive system (4) via a high-speed bus system, the drive bus (5). The drive system (4) is connected to the data bus (3). In the drive system (4), the positioning of the individual drives (*7a–d*) in relation to the folding unit (12) and in relation to one another is regulated. In addition, in the drive system (4), the matching of the data and instructions coming from the master control system (1) to the form required for the drive controllers (*6a–d*) is carried out. Overall regulation via the data bus (3) can therefore be restricted to a presetting of desired values, desired-value deviations and actual values and the desired-value command. The computation of the parameters for the fine adjustment of the individual drives (*7a–d*) is carried out separately in each printing-station group (*2a–d*) in the drive system (4).

In addition to the n drives and drive controllers (*7a–d* and *6a–d*), there are m input/output units (*9a–d*). They are connected to a control system (10) via a control bus (8). This control system (10) is itself connected to the data bus (3). The control system (10) coordinates the input/output units (*9a–d*) with one another and with the master control system (1). Here too, it becomes clear again how, figuratively speaking, responsibility is delegated by the master control system to the printing-station groups which are to a large degree autonomous. The overall control system can thereby have a simpler and more flexible construction.

Figure 3:
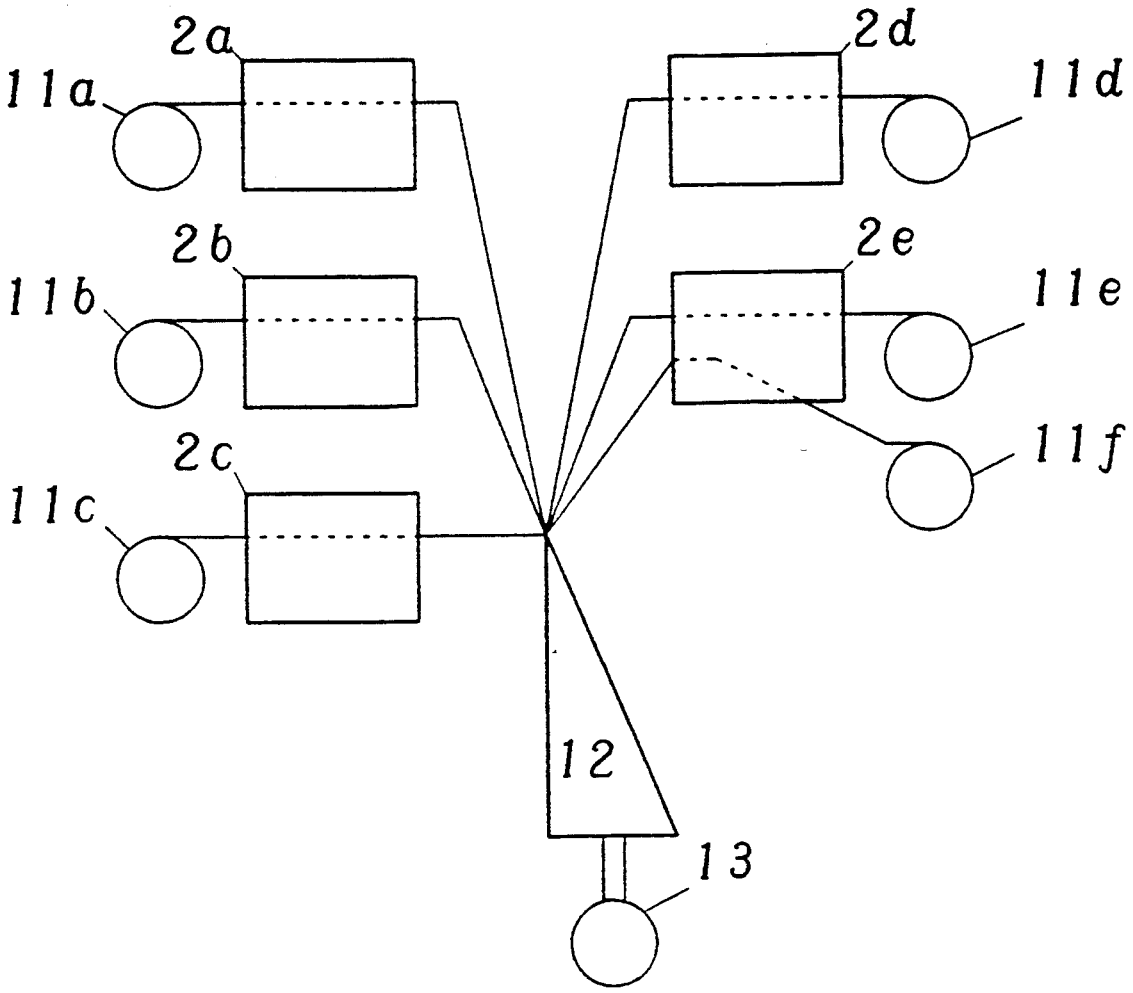
FIG. 3 shows a diagram of the assignment according to the invention of the printing-station groups on the folding unit.

Finally, FIG. 3 shows diagrammatically how the printing-station groups (*2a–e*) are assigned to a folding unit (12). Of course, there can also be a plurality of folding units (12) and the printing-station groups (*2a–e*) can be assigned to various folding units (12). For the sake of simplicity, however, FIG. 3 illustrates the situation with only one folding unit (12). The folding unit (12), like the cylinders of the printing-station groups (*2a–e*), is driven individually by means of a separate folding-unit drive (13). The individual printing-station groups (*2a–e*) obtain their paper from the paper-unrolling devices (*11a–f*). The printed paper web is cut and folded in the folding unit (12) and, for example, combined to form complete newspapers. Preferably, those individual drives of the cylinders which can be assigned to a common paper web form a printing-station group (*2a–b*). However, subgroups can also be formed with individual drives of the cylinders, so that one printing-station group (*2e*) can print a plurality of, for example two, paper webs simultaneously.

In conclusion, it can be said that the directly driven rotary printing machine according to the invention, because of the division of the overall control system into a master control system and autonomous printing-station groups, is distinguished by simplicity and flexibility and consequently satisfies the requirements which are necessary for the economical operation of a directly driven rotary printing machine.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A rotary printing machine, comprising a plurality of cylinders having individual drives in the form of respective electric motors such that the plurality of cylinders are driven individually by the respective electric motors, and at least one folding unit which is also driven individually by an electric motor, wherein:

a) the individual drives of the cylinders are controlled by respective drive controllers, the individual drives of the cylinders and their drive controllers forming a printing-station group, and wherein the printing machine includes a plurality of printing-station groups;

b) the plurality of printing-station groups are assigned to at least one folding unit and acquire a position reference from said at least one folding unit wherein management of the printing-station groups taking place by means of a master control system, wherein the master control system includes an operating and data-processing step;

c) the individual drives of the cylinders and their drive controllers of a printing-station group are connected by a high-speed drive bus system;

d) the plurality of printing-station groups are connected to one another and to the operating and data-processing unit by a data bus, the operating and data-processing unit managing the printing-station groups;

e) wherein the management comprises presetting of desired values and desired-value deviations, and a processing of actual values and coordinating a desired-value command of the printing-station groups relative to one another and relative to at least one folding unit; and f) wherein the at least one folding unit is connected to the printing-station groups by the data bus.

2. The rotary printing machine as claimed in claim 1, wherein the printing-station groups each comprise:

a) a drive system which is connected to the data bus and to the respective drive controllers, the connection to the drive controllers being made by the high-speed drive bus, and the drive system coordinates the drive controllers with one another;

b) a control system which is connected to the data bus; and c) input and output units which are connected to the master control system by a control bus, the management of the input and output units taking place in the master control system.

3. The rotary printing machine as claimed in claim 1, wherein the individual drives of the cylinders and their drive controllers, which are assigned to a common paper web, form a printing-station group.

4. The rotary printing machine as claimed in claim 1, wherein the printing-station groups are assigned to a plurality of folding units.

5. The rotary printing machine as claimed in claim 1, wherein the printing-station groups are divided into printing-station subgroups, and wherein plural paper webs can consequently be processed in a single printing-station group.

6. A rotary printing machine, comprising a plurality of cylinders having individual drives in the form of respective electric motors such that the plurality of cylinders are driven individually by the respective electric motors, and at least one folding unit which is also driven individually by an electric motor, wherein:

a) the individual drives of the cylinders are controlled by respective drive controllers, the individual drives of the cylinders and their drive controllers forming a printing-station group, and wherein the printing machine includes a plurality of printing-station groups;

b) the plurality of printing-station groups are assigned to at lest one folding unit and acquire a position reference from said at least one folding unit wherein management of the printing-station groups taking place by means of a master control system, wherein the master control system includes an operating and data-processing step;

c) the individual drives of the cylinders and their drive controllers of a printing-station group are connected by a high-speed drive bus system;

d) the plurality of printing-station groups are connected to one another and to the operating and data-processing unit by a data bus, the operating and data-processing unit managing the printing-station groups;

e) wherein the management comprises presetting of desired values and desired-value deviations, and a processing of actual values and coordinating a desired-value command of the printing-station groups relative to one another and relative to at least one folding unit; and f) wherein the folding unit is connected to the printing-station groups by a bus which is separate from said data bus.

7. The rotary printing machine as claimed in claim 6, wherein the printing-station groups each comprise:

a) a drive system which is connected to the data bus and to the respective drive controllers, the connection to the drive controllers being made by the high-speed drive bus, and the drive system coordinates drive controllers with one another;

b) a control system which is connected to the data bus; and c) input and output units which are connected to the master control system by a control bus, the management of the input and output units taking place in the master control system.

8. A rotary printing machine comprising:

a plurality of printing-station groups;

each printing-station group including at least one cylinder having an individual drive in the form of an electric motor, each printing-station group further including a drive controller associated with each individual drive, and wherein the individual drive and drive controller are coupled to a high-speed drive bus system;

said rotary printing machine further including at least one folding unit which is driven by an electric motor; and a master control system, said folding unit connected to said master control system and providing positioning information to said master control system, and wherein each of said plurality of printing-station groups are connected to said master control system.

9. The rotary printing machine of claim 8, wherein each printing-station group includes a plurality of cylinders and a plurality of respective individual drives in the form of electric motors, and further wherein a plurality of respective controllers are provided with one controller provided for each individual drive, and wherein each of said respective drive controllers are connected to said high-speed drive bus system.

10. The rotary printing machine of claim 9, wherein each printing-station group includes a drive system connected to said high-speed drive bus system, and wherein said drive system coordinates the drive controllers of a printing-station group with one another.

11. The rotary printing machine of claim 8, wherein said plurality of printing-station groups, said at least one folding unit and said master control system are each connected to a data bus.

* * * * *